US011174828B2

(12) United States Patent
Ono et al.

(10) Patent No.: US 11,174,828 B2
(45) Date of Patent: Nov. 16, 2021

(54) BOBBIN AND COIL DEVICE USING SAME

(71) Applicant: Mitsubishi Electric Corporation, Tokyo (JP)

(72) Inventors: Takuma Ono, Tokyo (JP); Mitsuyasu Okamoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 289 days.

(21) Appl. No.: 16/397,346

(22) Filed: Apr. 29, 2019

(65) Prior Publication Data

US 2020/0182214 A1 Jun. 11, 2020

(30) Foreign Application Priority Data

Dec. 6, 2018 (JP) ..... JP2018-228650

(51) Int. Cl.
*H01H 50/54* (2006.01)
*F02N 11/08* (2006.01)
(Continued)

(52) U.S. Cl.
CPC ..... *F02N 11/087* (2013.01); *H01F 5/02* (2013.01); *H01H 50/44* (2013.01); *H01H 51/065* (2013.01); *H01H 2050/446* (2013.01)

(58) Field of Classification Search
CPC ..... F02N 11/087; F02N 2011/0892; F02N 15/067; F02N 2011/0881; H01H 50/44;
(Continued)

(56) References Cited

U.S. PATENT DOCUMENTS 3,243,746 A * 3/1966 Doggart ..... H01F 27/266 336/92
3,661,342 A * 5/1972 Sears ..... H01F 5/02 242/118.41
(Continued)

FOREIGN PATENT DOCUMENTS

JP 63-131860 A 6/1988
JP 3-212909 A 9/1991
(Continued)

OTHER PUBLICATIONS

Communication dated May 14, 2019 issued by the Japanese Patent Office in counterpart application No. 2018-228650.
(Continued)

*Primary Examiner* — Shawki S Ismail
*Assistant Examiner* — Lisa N Homza
(74) *Attorney, Agent, or Firm* — Sughrue Mion, PLLC; Richard C. Turner

(57) ABSTRACT

This bobbin includes: a cylindrical winding portion, a first partition portion and a second partition portion, wherein the first partition portion has lead-in cutout portions through which the coil wire to be wound on the upper side and the coil wire to be wound on the lower side are to be respectively introduced, and lead-out cutout portions through which the coil wire to be wound on the upper side and the coil wire to be wound on the lower side are to be respectively led out, and the first partition portion has, on a winding portion side thereof, a step formed in a zone including a range between the lead-out cutout portion for the coil wire to be wound on the lower side and the lead-in cutout portion for the coil wire to be wound on the upper side.

14 Claims, 17 Drawing Sheets

(51) Int. Cl.
*H01H 50/44* (2006.01)
*H01H 51/06* (2006.01)
*H01F 5/02* (2006.01)

(58) Field of Classification Search
CPC .. H01H 51/065; H01H 2050/446; H01F 5/02; H01F 5/04
USPC ..... 335/2
See application file for complete search history.

(56) References Cited

U.S. PATENT DOCUMENTS 4,318,069 A * 3/1982 Morse ..... H01F 5/04 335/220
4,755,688 A 7/1988 Isozumi
4,779,068 A * 10/1988 Sakamoto ..... H01F 5/02 333/176
5,058,821 A * 10/1991 Yamashita ..... H01F 5/02 242/118.4
5,153,550 A * 10/1992 Sugiura ..... H01F 5/04 336/107
5,696,477 A 12/1997 Yamamori et al.
6,233,131 B1 * 5/2001 Kappel ..... H01H 50/30 361/115
8,212,643 B1 * 7/2012 Folker ..... H01F 27/2823 336/198
8,362,862 B2 1/2013 Bradfield
2006/0044103 A1 * 3/2006 Roebke ..... H01F 27/10 336/208
2008/0290979 A1 * 11/2008 Suzuki ..... H01F 41/076 336/192
2012/0002387 A1 * 1/2012 Park ..... H05B 41/02 361/760
2014/0001976 A1 * 1/2014 Park ..... H01F 5/04 315/276
2014/0002968 A1 * 1/2014 Nam ..... H01F 5/04 361/679.01
2014/0153209 A1 * 6/2014 Nam ..... H01F 27/325 361/782
2015/0097646 A1 * 4/2015 Park ..... H01F 5/02 336/185
2015/0116068 A1 * 4/2015 Kwon ..... H01F 27/2828 336/192
2016/0148737 A1 * 5/2016 Jung ..... H01F 7/1607 335/256
2016/0293317 A1 * 10/2016 Iwakura ..... H01F 27/2823
2017/0243687 A1 * 8/2017 Rylko ..... H01F 27/2823
2019/0381984 A1 * 12/2019 Chiba ..... H05K 5/0095
2020/0043640 A1 * 2/2020 Arai ..... H02K 1/146

FOREIGN PATENT DOCUMENTS

JP 8-51035 A 2/1996
JP 2003-133146 A 5/2003
JP 2003-209019 A 7/2003

OTHER PUBLICATIONS

Communication dated Apr. 1, 2021 from the China National Intellectual Property Administration in CN Application No. 201911190034.0.

* cited by examiner

BOBBIN AND COIL DEVICE USING SAME

BACKGROUND OF THE INVENTION

1. Field of the Invention

The present disclosure relates to a bobbin and a coil device using the same.

2. Description of the Background Art

Inside an electromagnetic switch device of a starter for starting an engine of an automobile, an electromagnetic solenoid is used as a coil device in which a coil wire is wound around a bobbin made of resin, for example. For the electromagnetic solenoid, it is necessary to adjust the resistance for slowly rotating a motor provided to the starter, and the ampere-turn for attracting a movable core. As a method for adjusting the resistance value and the ampere-turn, a method of reversing the direction for winding the coil wire in the middle of the winding is disclosed (see, for example, Patent Document 1).

As a specific reverse winding method, a method is disclosed in which the winding direction is reversed after a coil is tied to a projection provided to a partition of a bobbin during winding (see, for example, Patent Document 2).

Patent Document 1: Japanese Laid-Open Patent Publication No. 63-131860

Patent Document 2: U.S. Pat. No. 8,362,862

In Patent Document 1, the resistance value and the ampere-turn can be adjusted. However, winding disorder occurs when the direction for winding the coil wire is reversed in the middle of the winding. Therefore, the outer diameter of the wound coil is enlarged, so that the size of the coil device is increased. In addition, since the winding direction is reversed during the winding, the winding process is complicated.

In Patent Document 2, since the coil is tied to the projection to reverse the winding direction, winding disorder is suppressed. However, since the coil wire is tied to the projection provided to the partition, it is necessary to increase the thickness of the partition so as to ensure a space for the tying, leading to size increase of the bobbin. In addition, the projection is required to have a strength for tying the coil wire. Therefore, for example, if the projection is made of a metal material or the like different from the bobbin, a processing step of embedding the projection into the bobbin is needed. Thus, the bobbin manufacturing process is complicated and the size of the bobbin is increased.

SUMMARY OF THE INVENTION

The present disclosure has been made to solve the above problems, and an object of the present disclosure is to reduce the sizes of the bobbin and the coil device without complicating the manufacturing process.

A bobbin according to one aspect of the present disclosure includes: a cylindrical winding portion around which a coil wire is to be wound on a lower side and another coil wire is to be wound in an overlapping manner on an upper side thereof; and a first partition portion and a second partition portion respectively provided at both ends of the winding portion, wherein the first partition portion has lead-in cutout portions through which the coil wire to be wound on the upper side and the coil wire to be wound on the lower side are to be respectively introduced, and lead-out cutout portions through which the coil wire to be wound on the upper side and the coil wire to be wound on the lower side are to be respectively led out, and the first partition portion has, on a winding portion side thereof, a step formed in a zone including a range between the lead-out cutout portion for the coil wire to be wound on the lower side and the lead-in cutout portion for the coil wire to be wound on the upper side.

The bobbin according to one aspect of the present disclosure and a coil device using the same enable size reduction of the bobbin and the coil device without complicating the manufacturing process.

DETAILED DESCRIPTION OF THE PREFERRED EMBODIMENTS OF THE INVENTION

Figure 1:
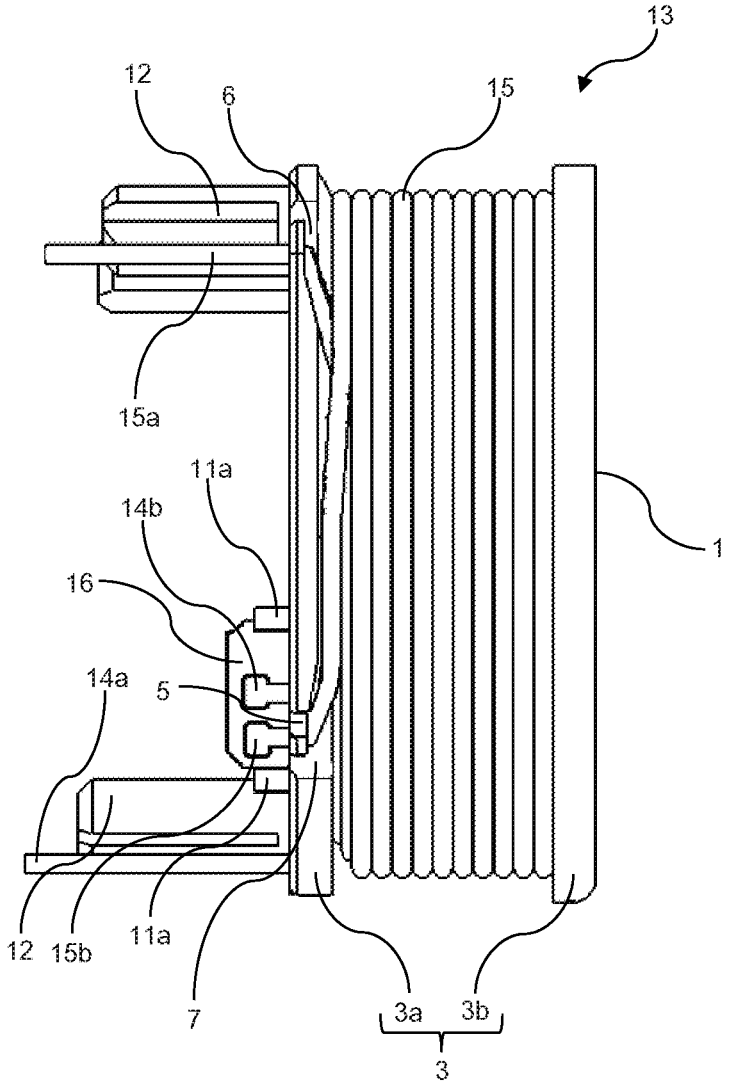
FIG. 1 is a side view of a coil device according to the first embodiment.

Hereinafter, a bobbin and a coil device using the same according to embodiments of the present disclosure will be described with reference to the drawings. Description will be given while the same or corresponding members and parts in the drawings are denoted by the same reference characters.

First Embodiment

Figure 2:
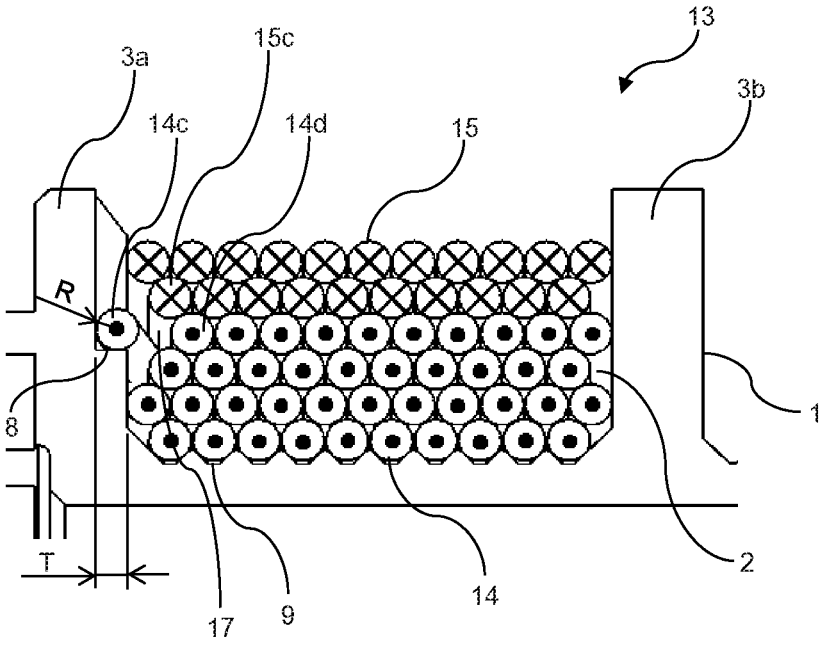
FIG. 2 is a sectional view of a part of the coil device according to the first embodiment.
Figure 3:
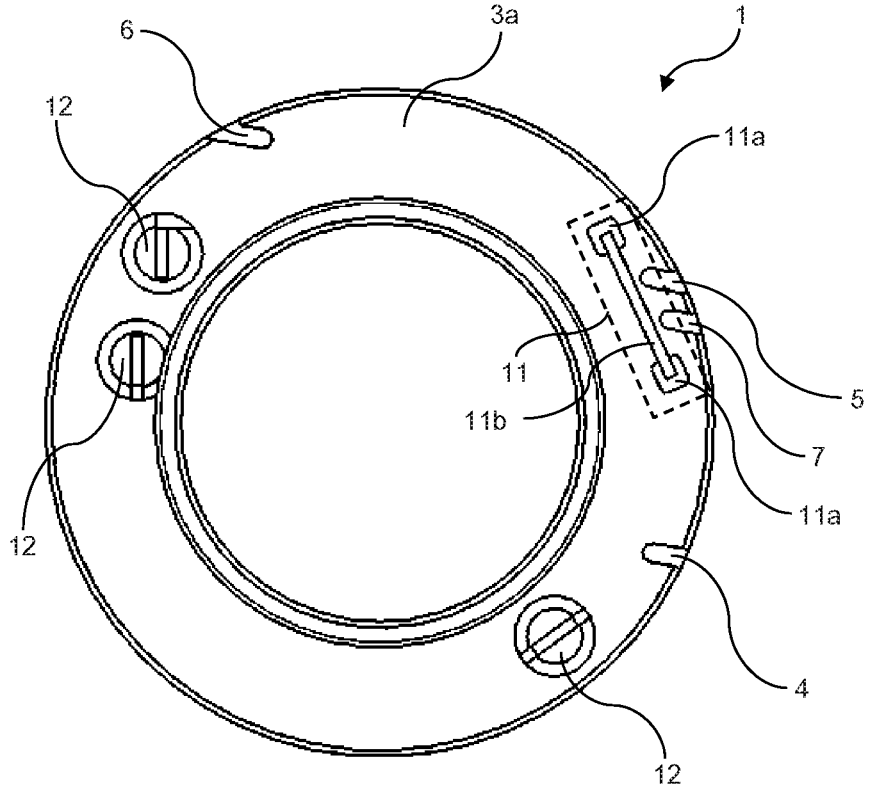
FIG. 3 is a front view of a bobbin according to the first embodiment.
Figure 4:
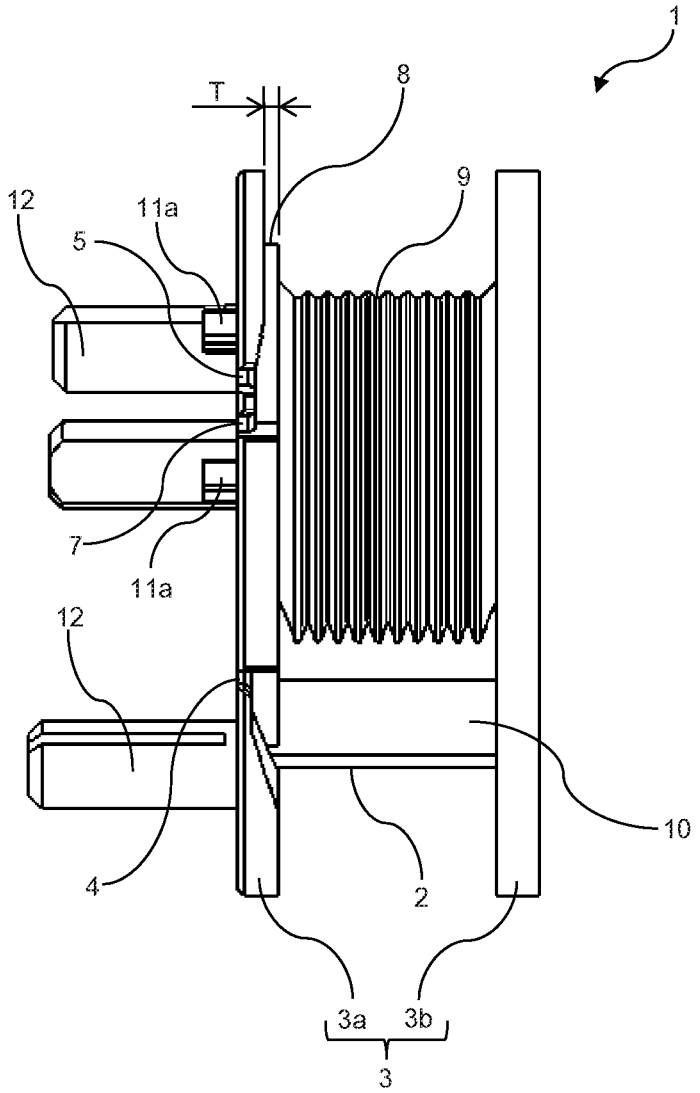
FIG. 4 is a side view of the bobbin according to the first embodiment.

FIG. 1 is a side view of a coil device according to the first embodiment, FIG. 2 is a sectional view of a part of the coil device, FIG. 3 is a front view of a bobbin, and FIG. 4 is a side view of the bobbin. A coil device 13 includes: a bobbin 1 having a cylindrical winding portion 2 around which a first coil wire and a second coil wire are wound, and partition portions 3 provided at both ends of the winding portion 2, as shown in FIG. 4; and a first coil wire 14 and a second coil wire 15 wound in an overlapping manner on the upper side of the first coil wire 14, as shown in FIG. 2.

First, the bobbin 1 will be described. The bobbin 1 is manufactured by molding a resin material, for example. In FIG. 4, the partition portion 3 at the left is referred to as a first partition portion 3*a*, and the partition portion 3 at the right is referred to as a second partition portion 3*b*. FIG. 3 shows a side of the first partition portion 3*a* that is opposite to the winding portion 2.

As shown in FIG. 3, the first partition portion 3*a* has four cutouts along the outer circumference. The four cutouts are a first coil wire lead-in cutout portion 4 for introducing the first coil wire 14 to the winding portion 2, a first coil wire lead-out cutout portion 5 for leading out the first coil wire 14 from the winding portion 2, a second coil wire lead-in cutout portion 6 for introducing the second coil wire 15 to the winding portion 2, and a second coil wire lead-out cutout portion 7 for leading out the second coil wire 15 from the winding portion 2.

The first partition portion 3*a* has a terminal mounting portion 11 and three positioning portions 12. The terminal mounting portion 11 is a part where a terminal 16 described later is mounted, and is adjacent to the first coil wire lead-out cutout portion 5 and the second coil wire lead-out cutout portion 7 which are arranged side by side. The terminal mounting portion 11 is formed from a mounting groove portion lib and two projection portions 11*a* to which the terminal 16 is inserted and fixed. The positioning portions 12 are projections for positioning when the coil device 13 is mounted to an electromagnetic switch device for starter.

As shown in FIG. 4, the winding portion 2 has a groove portion 9 and a non-groove portion 10 on the side surface thereof. The groove portion 9 is a groove for winding the first coil wire 14 in a regular form, and is formed to have a groove width corresponding to the wire diameter of the first coil wire 14 and have a groove number corresponding to a predetermined number of winding turns. The non-groove portion 10 is a side surface of the winding portion 2 where no groove portion 9 is formed, and is a cross-point part where the first coil wire 14 passes when the first coil wire 14 moves to the next groove during winding of the first coil wire 14 (see FIG. 6 described later). As shown in FIG. 2, the first coil wire 14 is regularly wound in four layers on the lower side at the winding portion 2, and the second coil wire 15 having the same wire diameter as the first coil wire 14 is regularly wound in two layers in an overlapping manner on the upper side of the first coil wire 14.

As shown in FIG. 4, the first partition portion 3*a* has a step 8 at a part thereof on the winding portion 2 side. As shown in FIG. 2, the first partition portion 3*a* is partially cut such that a depth T of the step 8 satisfies T R, where R is the wire radius of the first coil wire 14 which is a coil wire wound on the lower side. The step 8 is formed with a length of approximately half round of the winding portion 2, in a zone including the range between the second coil wire lead-in cutout portion 6 and the first coil wire lead-out cutout portion 5. Approximately half round of a first coil wire 14*c* which is the last one turn (hereinafter, referred to as final turn) of the first coil wire 14 is wound along the step 8 formed on the first partition portion 3*a*. Between the first coil wire 14*c* and a first coil wire 14*d* which is the adjacent turn wound adjacently thereto, a gap 17 not smaller than a wire radius R of the first coil wire 14 is formed. Owing to the presence of the step 8, the first coil wire 14*c* and the first coil wire 14*d* are prevented from being wound in an overlapping manner, and thus winding disorder which would occur at the end of the winding is suppressed.

A second coil wire 15*c* which is the first one turn of the second coil wire 15 introduced through the second coil wire lead-in cutout portion 6 is provided in an overlapping manner on the gap 17. The step 8 is provided in a zone in which the second coil wire 15 is started to be wound. By starting the winding of the second coil wire 15 from the gap 17 formed along the step 8, it is possible to start winding the second coil wire 15 smoothly without the second coil wire 15*c* and the first coil wire 14*c* interfering with each other, and thus winding disorder at the start of winding can be suppressed.

As shown in FIG. 1, at the projection portions 11*a*, the terminal 16 is provided to which an end portion 14*b* of the first coil wire led out from the first coil wire lead-out cutout portion 5 and an end portion 15*b* of the second coil wire led out from the second coil wire lead-out cutout portion 7 are connected by, for example, welding. The first coil wire 14 and the second coil wire 15 are connected in series via the terminal 16 which is a metal plate made of copper, for example. When the coil device 13 is mounted to the electromagnetic switch device for starter described in the second embodiment, a winding start portion 14*a* of the first coil wire and a winding start portion 15*a* of the second coil wire are connected to a terminal provided to the electromagnetic switch device for starter.

FIG. 2 shows the direction of current flowing through the first coil wire 14 and the second coil wire 15. The first coil wire 14 and the second coil wire 15 are each wound in an even number of layers in the direction in which the step 8 is provided from the second coil wire lead-in cutout portion 6 to the first coil wire lead-out cutout portion 5, and the end portion 14*b* of the first coil wire and the end portion 15*b* of the second coil wire are connected to each other. Therefore, current flows through the first coil wire 14 and the second coil wire 15 in directions opposite to each other. Since current flows in the opposite directions, the ampere-turns occurring on the first coil wire 14 and the second coil wire 15 act so as to cancel out each other. Thus, it is possible to adjust the ampere-turn and the resistance value for the coil device 13. It is noted that, since the first coil wire lead-in cutout portion 4, the first coil wire lead-out cutout portion 5, the second coil wire lead-in cutout portion 6, and the second coil wire lead-out cutout portion 7 are provided to the first partition portion 3*a*, the first coil wire 14 and the second coil wire 15 are each wound in an even number of layers.

Figure 5:
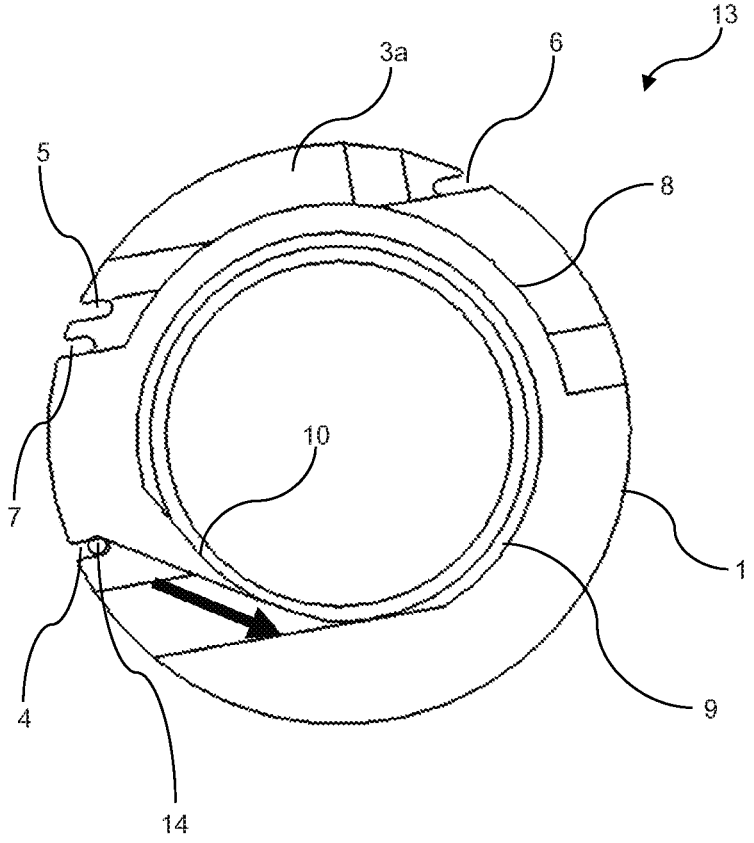
FIG. 5 is a front view showing the procedure for winding a first coil wire in the coil device according to the first embodiment, before winding.
Figure 6:
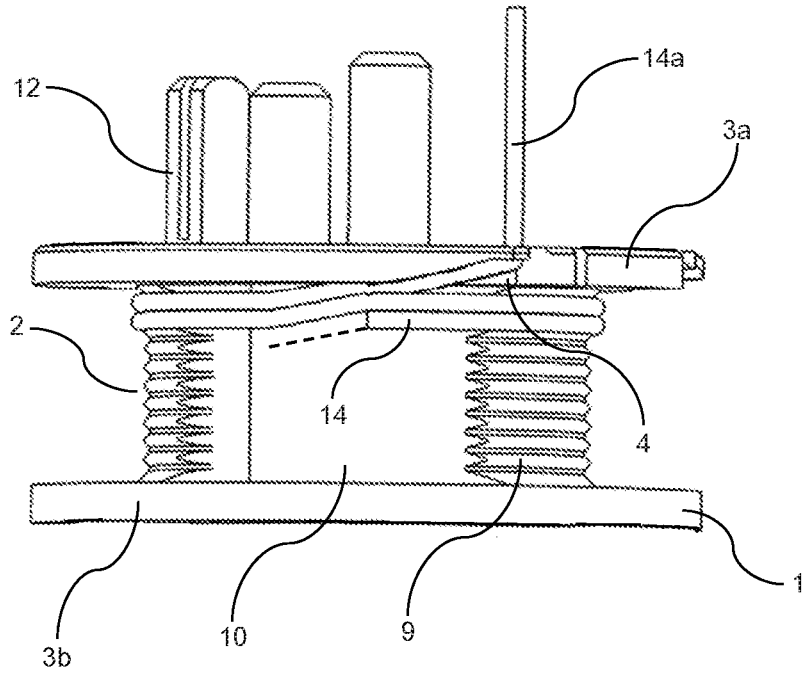
FIG. 6 is a side view showing the procedure for winding the first coil wire in the coil device according to the first embodiment, during winding.
Figure 7:
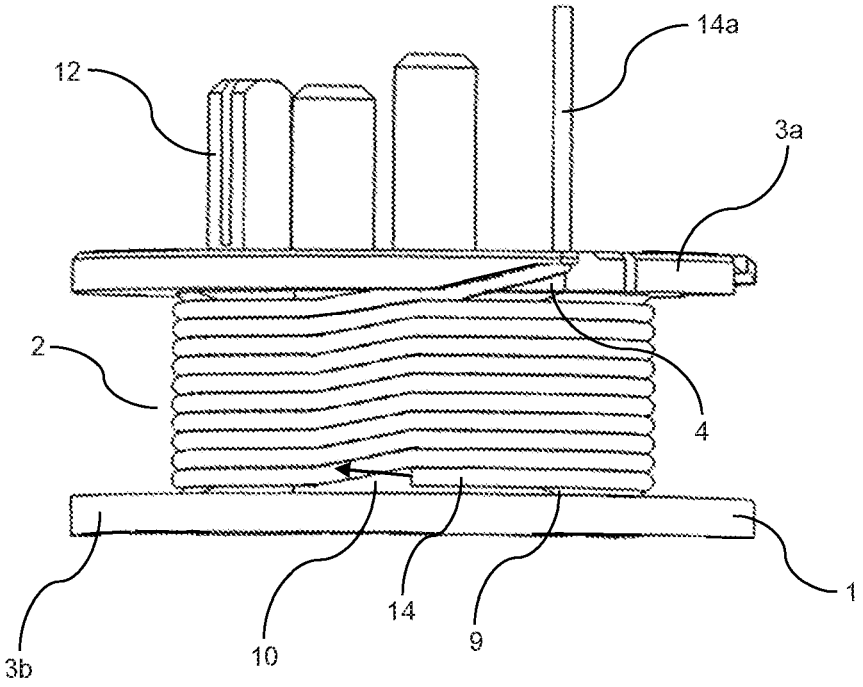
FIG. 7 is a side view showing the procedure for winding the first coil wire in the coil device according to the first embodiment, at another timing during winding.
Figure 8:
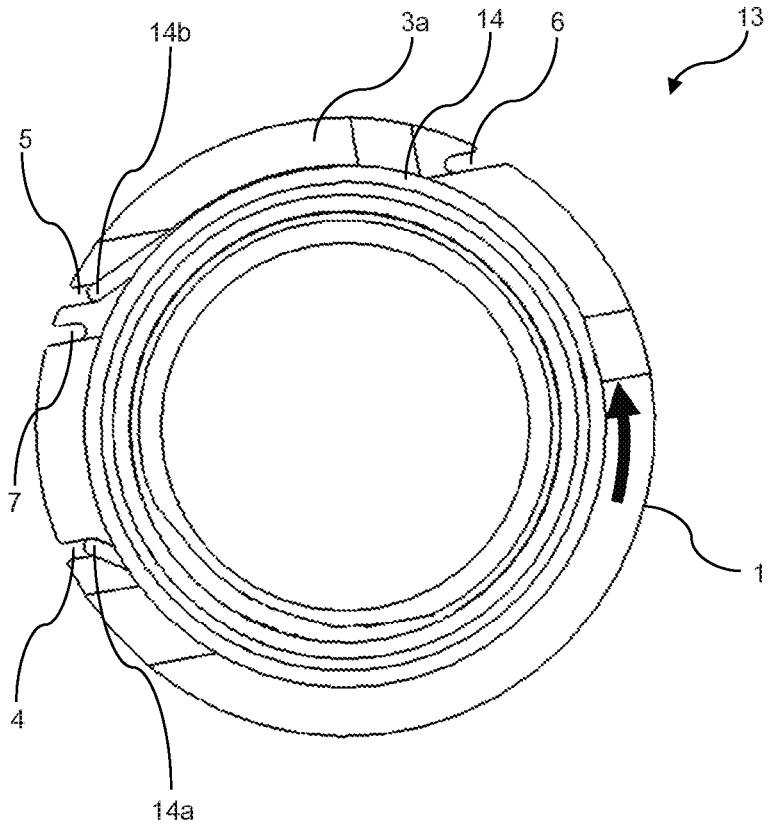
FIG. 8 is a front view showing the procedure for winding the first coil wire in the coil device according to the first embodiment, after winding.
Figure 9:
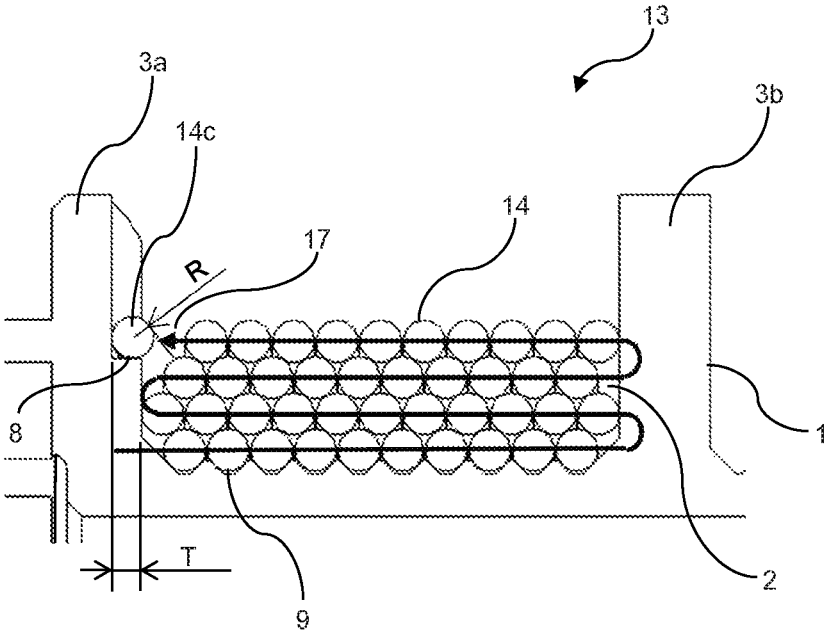
FIG. 9 is a sectional view showing the procedure for winding the first coil wire in the coil device according to the first embodiment, after winding.

The winding method for the first coil wire 14 and the second coil wire 15 will be described. First, winding of the first coil wire 14 around the bobbin 1 will be described. FIG. 5 is a front view showing the procedure for winding the first coil wire in the coil device according to the first embodiment, before winding. FIG. 6 is a side view showing the procedure for winding the first coil wire in the coil device, during winding. FIG. 7 is a side view showing the procedure for winding the first coil wire in the coil device, at another timing during winding. FIG. 8 is a front view showing the procedure for winding the first coil wire in the coil device, after winding. FIG. 9 is a sectional view showing the procedure for winding the first coil wire in the coil device, after winding. FIG. 5 and FIG. 8 are views when the first partition portion 3*a* is seen from the second partition portion 3*b* side. As shown in an arrow in FIG. 5, the first coil wire 14 is introduced from the first coil wire lead-in cutout portion 4 toward the non-groove portion 10 of the bobbin 1. Then, the first coil wire 14 is wound along the first groove portion 9 adjacent to the first partition portion 3*a*. As shown in FIG. 6, when the first coil wire 14 moves from one groove portion 9 to the adjacent groove portion 9, the first coil wire 14 passes the non-groove portion 10. As shown by an arrow in FIG. 7, after the first layer is formed, the first coil wire 14 is wound along an upper part between the first coil wires 14 in the first layer already formed, whereby the second layer of the first coil wire 14 is formed regularly. As shown by an arrow in FIG. 8, after the third layer and the fourth layer are formed in the same manner, the first coil wire 14 is led through the first coil wire lead-out cutout portion 5 to outside of the first partition portion 3*a*. As shown by an arrow in FIG. 9, the first coil wire 14 is regularly wound within the range of the winding portion 2 by a predetermined number of turns. Approximately half round of the final turn of the first coil wire 14 is wound along the step 8 so as to form the gap 17. Therefore, winding disorder does not occur at the end of winding.

Figure 10:
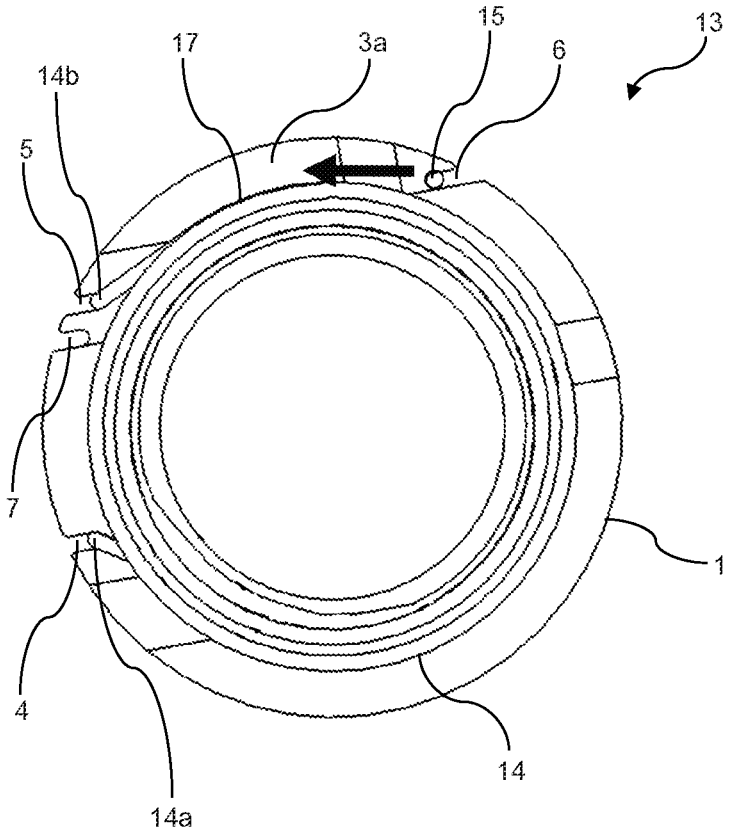
FIG. 10 is a front view showing the procedure for winding a second coil wire in the coil device according to the first embodiment, before winding.
Figure 11:
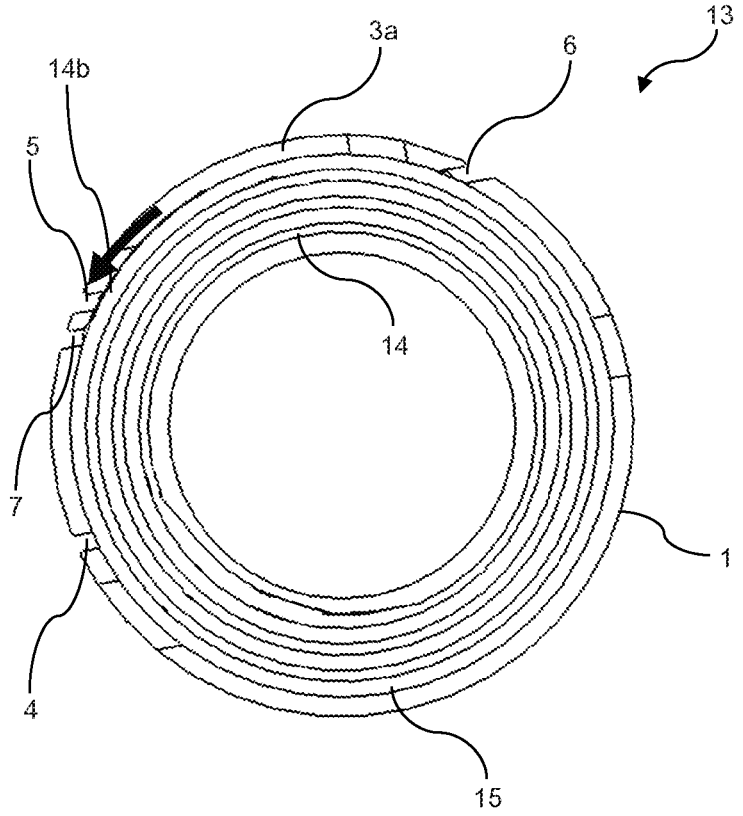
FIG. 11 is a front view showing the procedure for winding the second coil wire in the coil device according to the first embodiment, after winding.
Figure 12:
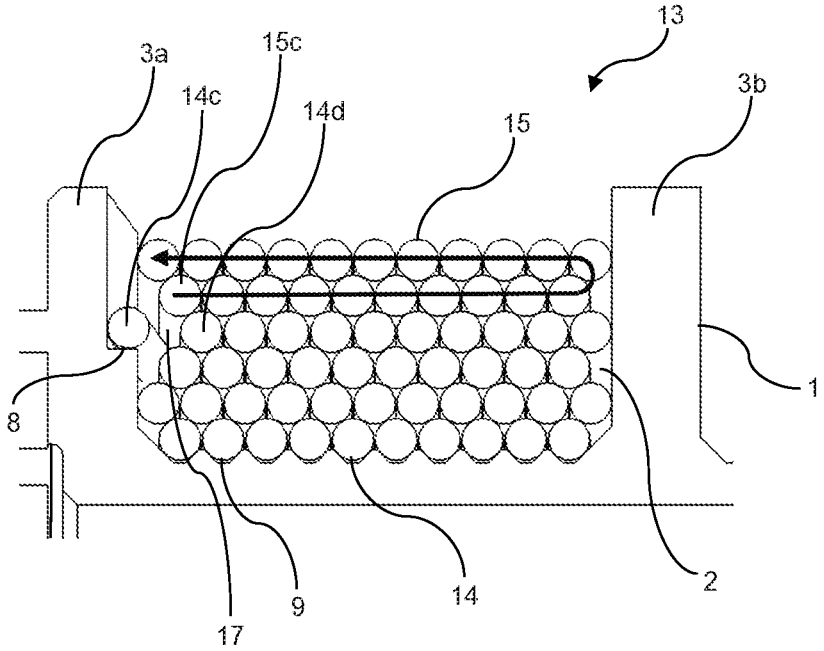
FIG. 12 is a sectional view showing the procedure for winding the second coil wire in the coil device according to the first embodiment, after winding.

Winding of the second coil wire 15 around the bobbin 1 will be described. FIG. 10 is a front view showing the procedure for winding the second coil wire in the coil device according to the first embodiment, before winding. FIG. 11 is a front view showing the procedure for winding the second coil wire in the coil device, after winding. FIG. 12 is a sectional view showing the procedure for winding the second coil wire in the coil device, after winding. FIG. 10 and FIG. 11 are views when the first partition portion 3*a* is seen from the second partition portion 3*b* side. As shown by an arrow in FIG. 10, the second coil wire 15 is introduced from the second coil wire lead-in cutout portion 6 toward the gap 17. Therefore, it is possible to start winding the second coil wire 15 smoothly. Then, the second coil wire 15 is wound along an upper part between the first coil wires 14 already wound. As shown by an arrow in FIG. 11, after the second layer is formed on the second coil wires 15 in the first layer already formed, the second coil wire 15 is led through the second coil wire lead-out cutout portion 7 to outside of the first partition portion 3*a*. As shown by an arrow in FIG. 12, the second coil wire 15 is regularly wound on the upper side of the first coil wire 14 within the range of the winding portion 2 by a predetermined number of turns. After the second coil wire 15 is wound, the end portion 14*b* of the first coil wire and the end portion 15*b* of the second coil wire are connected to the terminal 16.

The numbers of layers of the first coil wire 14 and the second coil wire 15 are four and two, respectively. However, without limitation thereto, the numbers of layers may be changed in accordance with the specifications of the coil device 13. It is noted that the numbers of layers of both coil wires are even numbers. In the case of performing such change, the step 8 is formed so as to correspond to the position of the final layer of the first coil wire 14. In addition, also in the case of performing the change, the second coil wire 15 is used for adjusting the resistance value and the ampere-turn, and therefore is formed in a smaller number of layers than the first coil wire 14.

The configuration of the terminal mounting portion 11 is not limited to the two projection portions 11*a* and the mounting groove portion lib. For example, the terminal 16 may be fitted to a recess provided to the first partition portion 3*a*. Alternatively, without particularly providing a structure for mounting the terminal 16, to the first partition portion 3*a*, for example, the terminal 16 may be bonded to the first partition portion 3*a*.

As described above, in the above bobbin 1, the first coil wire lead-in cutout portion 4, the first coil wire lead-out cutout portion 5, the second coil wire lead-in cutout portion 6, and the second coil wire lead-out cutout portion 7 are all provided to the first partition portion 3*a*, and therefore the bobbin 1 can be downsized. In addition, since the step 8 is provided to the first partition portion 3*a*, winding disorder in which the first coil wire 14 is wound in an overlapping manner is suppressed, and since the gap 17 is formed, the second coil wire 15 can be started to be wound smoothly and can be regularly wound. Therefore, the outer diameters of the first coil wire 14 and the second coil wire 15 can be reduced, whereby the coil device 13 can be downsized. In addition, the depth T of the step 8 is set to satisfy T R, where R is the radius of the first coil wire 14. Therefore, the gap 17 is assuredly formed, and the second coil wire 15 can be regularly wound. In addition, the end portion 14*b* of the first coil wire and the end portion 15*b* of the second coil wire are connected by the terminal 16, and therefore, without complicating the winding process or increasing the size of the bobbin 1, it is possible to cause current to flow through the first coil wire 14 and the second coil wire 15 in directions opposite to each other. In addition, the bobbin 1 can be manufactured by molding without complicating the manufacturing process.

Second Embodiment

Figure 13:
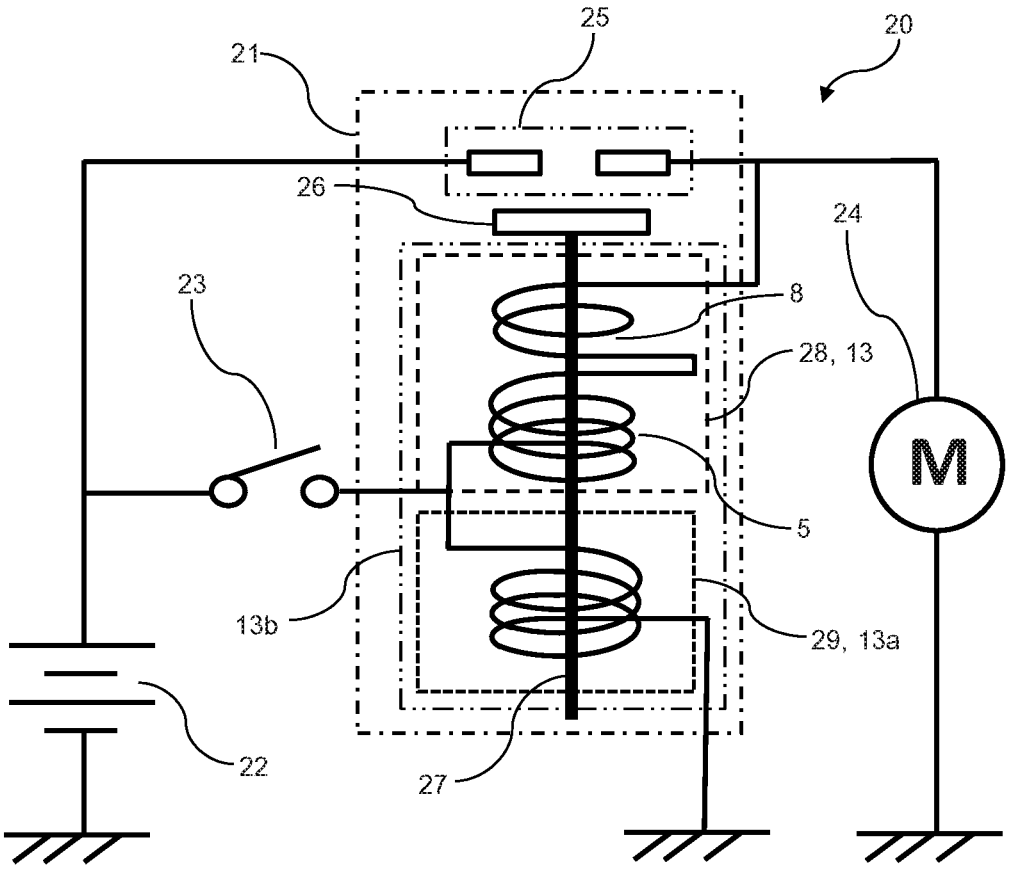
FIG. 13 is a circuit diagram schematically showing a starter provided with a bobbin and a coil device using the same, according to the second embodiment.
Figure 14:
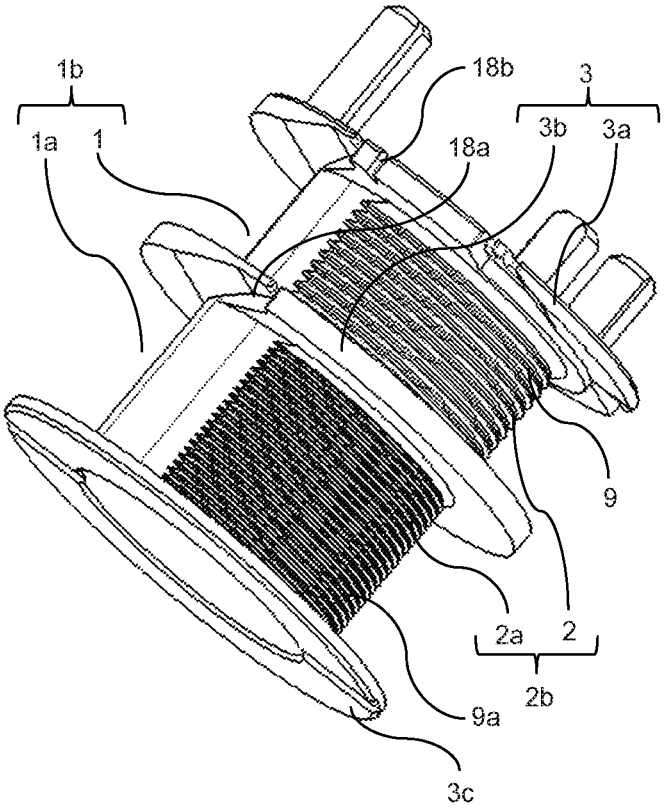
FIG. 14 is a perspective view of the bobbin according to the second embodiment.
Figure 15:
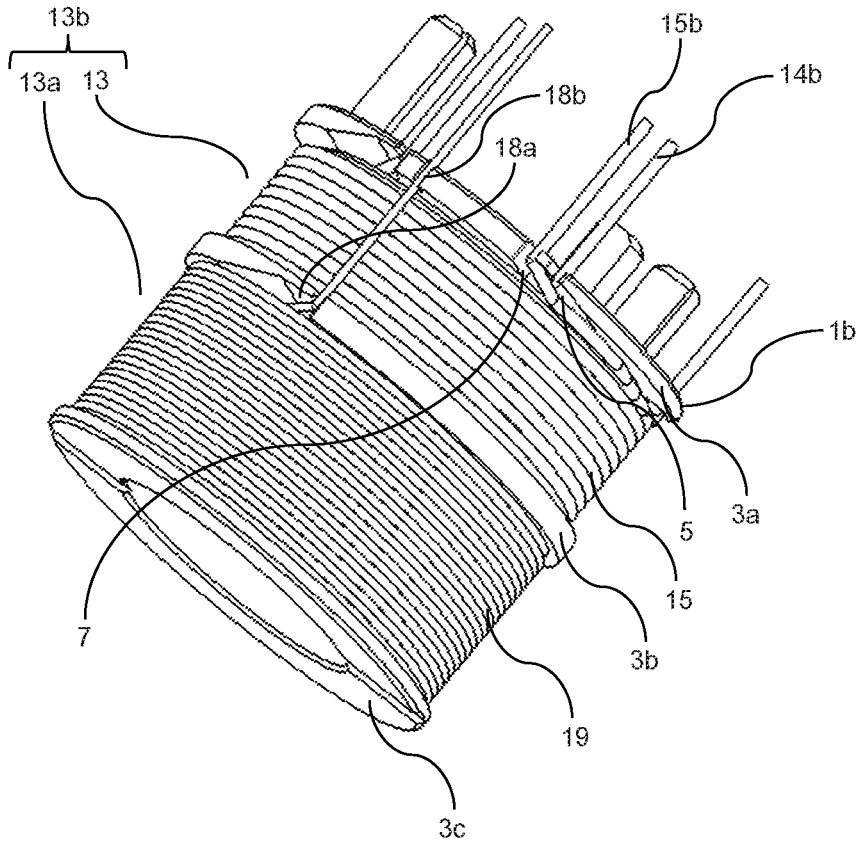
FIG. 15 is a perspective view of the coil device according to the second embodiment.

In the second embodiment, a configuration in which the bobbin 1 and the coil device 13 using the same, described in the first embodiment, are used for an attraction coil 28 of an electromagnetic switch device 21 for starter, will be described. FIG. 13 is a circuit diagram schematically showing a starter provided with the bobbin and the coil device using the same, according to the second embodiment, FIG. 14 is a perspective view of the bobbin, and FIG. 15 is a perspective view of the coil device. A bobbin 1*b* is formed by integrating the bobbin 1 shown in the first embodiment and a bobbin 1*a* having a cylindrical second winding portion 2*a* around which a third coil wire 19 is wound and a third partition portion 3*c*. A coil device 13*b* is formed by integrating the coil device 13 shown in the first embodiment and another coil device 13*a* composed of the cylindrical second winding portion 2*a* around which the third coil wire 19 is wound, the third partition portion 3*c*, and the third coil wire 19.

As shown in FIG. 13, a starter 20 is composed of the electromagnetic switch device 21, a battery 22, an auxiliary relay 23, and a motor 24. The electromagnetic switch device 21 includes a pair of fixed contacts 25, a movable contact 26, a movable core 27, the attraction coil 28 to which the coil device 13 described in the first embodiment is applied, and a retention coil 29 formed by the coil device 13*a* described later.

The outline of operation of the starter 20 will be described. One of the pair of fixed contacts 25 is connected to the battery 22, and the other one is connected to the motor 24. One end of each of the attraction coil 28 and the retention coil 29 is connected to the battery 22 via the auxiliary relay 23, and thus current is supplied to the attraction coil 28 and the retention coil 29. The other end of the retention coil 29 is short-circuited to the ground, and while the auxiliary relay 23 is actuated, current is supplied to the retention coil 29, and therefore a force is applied to the movable core 27 so as to retain the movable core 27 at a predetermined position. In addition, while the auxiliary relay 23 is actuated, current is also supplied to the attraction coil 28 from the battery 22, and therefore an attraction force for moving the movable core 27 against the force for retaining the movable core 27 is generated in the attraction coil 28, so that the movable contact 26 engaged with the movable core 27 moves toward the pair of fixed contacts 25. At this time, since the other end of the attraction coil 28 is connected to the motor 24, current flowing through the attraction coil 28 is also supplied to the motor 24, whereby the motor 24 rotates slowly and a pinion (not shown) connected to the motor 24 also rotates, so that the pinion can be engaged with a ring gear (not shown) of an engine. For the attraction coil 28, the resistance value needs to be adjusted so as to slowly rotate the motor 24, and the ampere-turn needs to be adjusted so as to attract the movable core 27. Therefore, for the attraction coil 28, the coil device 13 described in the first embodiment is used in which current is caused to flow through the first coil wire 14 and the second coil wire 15 in directions opposite to each other and the resistance value and the ampere-turn are adjusted.

Finally, the movable contact 26 comes into contact with the pair of fixed contacts 25, so that current is directly supplied from the battery 22 to the motor 24 and the motor 24 fully rotates, whereby it is possible to start the engine via the ring gear engaged with the pinion.

Next, the bobbin 1*b* will be described. As shown in FIG. 14, the bobbin 1*b* is composed of the bobbin 1 and the bobbin 1*a*. The bobbin 1*b* is formed such that, integrally with the bobbin 1, the cylindrical second winding portion 2*a* for winding the third coil wire is provided on a side of the second partition portion 3*b* that is opposite to the winding portion 2, and the third partition portion 3*c* is provided at an end of the second winding portion 2*a*. The second partition portion 3*b* serves as an intermediate partition portion for dividing a winding portion 2*b* of the bobbin 1*b* into two. The bobbin 1 is formed by the winding portion 2 and the partition portions 3 shown in FIG. 4. The bobbin 1*a* is formed by the winding portion 2*a* and the third partition portion 3*c*. The second partition portion 3*b* has a third coil wire lead-in cutout portion 18*a* for introducing the third coil wire 19 to be wound around the second winding portion 2*a*, to the second winding portion 2*a*, and a third coil wire lead-out cutout portion (not shown) for leading out the third coil wire 19 from the second winding portion 2*a*. The first partition portion 3*a* has a third coil wire lead-in cutout portion 18*b* for introducing the third coil wire 19 to the bobbin 1*b*, and a third coil wire lead-out cutout portion (not shown) for leading out the third coil wire 19 from the bobbin 1*b*. The first coil wire 14 and the second coil wire 15 are wound around the winding portion 2, and the third coil wire 19 is wound around the second winding portion 2*a*. The first coil wire 14 wound on the lower side at the winding portion 2 and the third coil wire 19 have wire diameters different from each other. Therefore, the winding portion 2 and the second winding portion 2*a* are respectively provided with the groove portion 9 and a groove portion 9*a* having different widths and having groove numbers corresponding to predetermined numbers of winding turns.

The coil device 13*b* in which a plurality of coil wires are wound around the bobbin 1*b* will be described. As shown in FIG. 15, the coil device 13*b* is composed of the coil device 13 and the coil device 13*a*. The coil device 13 has the same configuration as that shown in FIG. 4, in which the first coil wire 14 (not shown) and the second coil wire 15 are wound around the winding portion 2 of the bobbin 1*b* shown in FIG. 14, as described in the first embodiment. On a side of the first partition portion 3*a* that is opposite to the winding portion 2, the terminal (not shown) for connecting the end portion 14*b* of the first coil wire 14 led out through the first coil wire lead-out cutout portion 5 and the end portion 15*b* of the second coil wire 15 led out through the second coil wire lead-out cutout portion 7 is provided at the terminal mounting portion (not shown), as in the case of FIG. 4. In the coil device 13*a*, the third coil wire 19 is wound around the second winding portion 2*a* of the bobbin 1*b* shown in FIG. 14. The third coil wire 19 is introduced through the third coil wire lead-in cutout portion 18*b* and the third coil wire lead-in cutout portion 18*a* to the bobbin 1*a*.

As described above, since the bobbin 1*b* is formed by integrating the bobbin 1 and the bobbin 1*a*, the bobbin 1*b* can be downsized. In addition, since the coil device 13*b* is formed by integrating the coil device 13 and the coil device 13*a*, the coil device 13*b* can be downsized.

Third Embodiment

Figure 16:
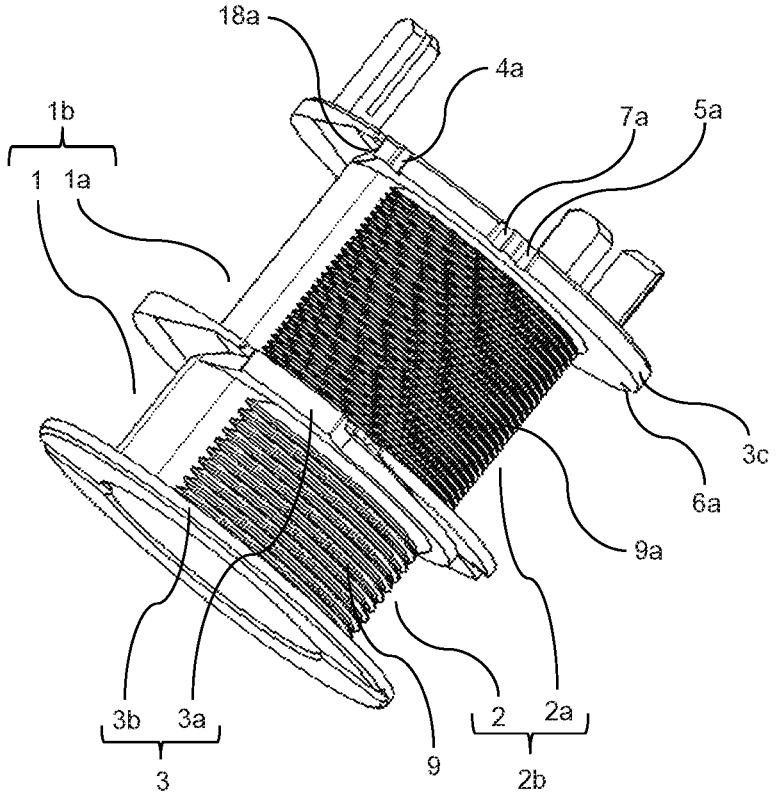
FIG. 16 is a perspective view of a bobbin according to the third embodiment.

In the third embodiment, a configuration in which the positions of the winding portion 2 and the second winding portion 2*a* of the bobbin 1*b* and the coil device 13*b* using the same, described in the second embodiment, are replaced with each other, will be described. FIG. 16 is a perspective view of a bobbin according to the third embodiment, and FIG. 17 is a perspective view of a coil device.

As shown in FIG. 16, the bobbin 1*b* is composed of the bobbin 1 and the bobbin 1*a*. The bobbin 1*b* is formed such that, integrally with the bobbin 1, the cylindrical second winding portion 2*a* for winding the third coil wire 19 is provided on a side of the first partition portion 3*a* that is opposite to the winding portion 2, and the third partition portion 3*c* is provided at an end of the second winding portion 2*a*. The first partition portion 3*a* serves as an intermediate partition portion for dividing the winding portion 2*b* of the bobbin 1*b* into two. The bobbin 1 is formed by the winding portion 2 and the partition portions 3 shown in FIG. 4. The bobbin 1*a* is formed by the winding portion 2*a* and the third partition portion 3*c*. The third partition portion 3*c* has a third coil wire lead-in cutout portion 18*a* for introducing the third coil wire 19 to be wound around the second winding portion 2*a*, to the second winding portion 2*a*, and a third coil wire lead-out cutout portion (not shown) for leading out the third coil wire 19 from the second winding portion 2*a*. The third partition portion 3*c* has a second lead-in cutout portion 4*a* for introducing the first coil wire 14 to the bobbin 1*b*, a second lead-out cutout portion 5*a* for leading out the first coil wire 14 from the bobbin 1*b*, a second lead-in cutout portion 6*a* for introducing the second coil wire 15 to the bobbin 1*b*, and a second lead-out cutout portion 7*a* for leading out the second coil wire 15 from the bobbin 1*b*. The first coil wire 14 and the second coil wire 15 are wound around the winding portion 2, and the third coil wire 19 is wound around the second winding portion 2*a*. After the third coil wire 19 is wound, the first coil wire 14 and the second coil wire 15 are wound.

Figure 17:
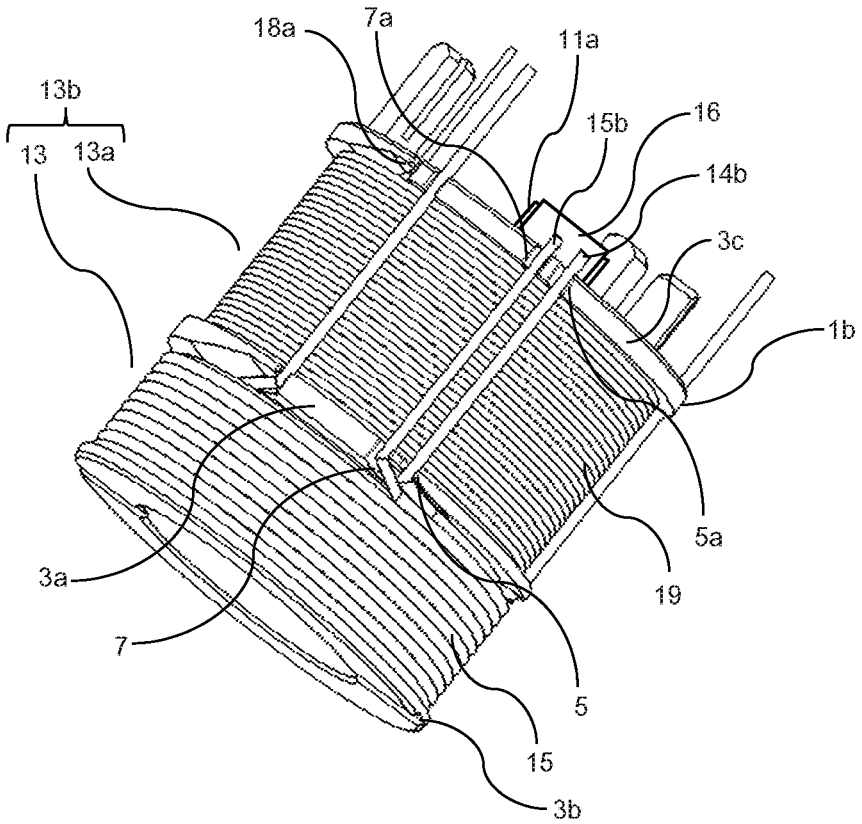
FIG. 17 is a perspective view of a coil device according to the third embodiment.

As shown in FIG. 17, the coil device 13*b* is composed of the coil device 13 and the coil device 13*a*. In the coil device 13, as described in the first embodiment, the first coil wire 14 (not shown) and the second coil wire 15 are wound around the winding portion 2 of the bobbin 1*b* shown in FIG. 16. At the projection portions 11*a* of the terminal mounting portion 11 provided on a side of the third partition portion 3*c* that is opposite to the second winding portion 2*a*, the terminal 16 is provided to which the end portion 14*b* of the first coil wire 14 passing through the first coil wire lead-out cutout portion 5 and then led out from the second lead-out cutout portion 5*a*, and the end portion 15*b* of the second coil wire 15 passing through the second coil wire lead-out cutout portion 7 and then led out from the second lead-out cutout portion 7*a*, are connected. In the coil device 13*a*, the third coil wire 19 is wound around the second winding portion 2*a* of the bobbin 1*b* shown in FIG. 16. The third coil wire 19 is introduced through the third coil wire lead-in cutout portion 18*a* to the bobbin 1*b*.

As described above, since the bobbin 1*b* is formed by integrating the bobbin 1 and the bobbin 1*a*, the bobbin 1*b* can be downsized. In addition, since the coil device 13*b* is formed by integrating the coil device 13 and the coil device 13*a*, the coil device 13*b* can be downsized.

Although the disclosure is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations to one or more of the embodiments of the disclosure.

It is therefore understood that numerous modifications which have not been exemplified can be devised without departing from the scope of the present disclosure. For example, at least one of the constituent components may be modified, added, or eliminated. At least one of the constituent components mentioned in at least one of the preferred embodiments may be selected and combined with the constituent components mentioned in another preferred embodiment.

DESCRIPTION OF THE REFERENCE CHARACTERS

1 bobbin
1*b* bobbin
2 winding portion
2*a* second winding portion
3 partition portion
3*a* first partition portion
3*b* second partition portion
3*c* third partition portion
4 first coil wire lead-in cutout portion
4*a* second lead-in cutout portion
5 first coil wire lead-out cutout portion
5*a* second lead-out cutout portion
6 second coil wire lead-in cutout portion
6*a* second lead-in cutout portion
7 second coil wire lead-out cutout portion
7*a* second lead-out cutout portion
8 step
9 groove portion
10 non-groove portion
11 terminal mounting portion
12 positioning portion
13 coil device
14 first coil wire
14*b* end portion
15 second coil wire
15*b* end portion
16 terminal
17 gap
18*a* third coil wire lead-in cutout portion
19 third coil wire
20 starter
21 electromagnetic switch device
22 battery
23 auxiliary relay
24 motor
25 pair of fixed contacts
26 movable contact
27 movable core
28 attraction coil
29 retention coil

What is claimed is:

1. A bobbin comprising:

a cylindrical winding portion around which a coil wire is to be wound on a lower side and another coil wire is to be wound in an overlapping manner on an upper side thereof; and a first partition portion and a second partition portion respectively provided at both ends of the winding portion, wherein the first partition portion has lead-in cutout portions through which the coil wire to be wound on the upper side and the coil wire to be wound on the lower side are to be respectively introduced, and lead-out cutout portions through which the coil wire to be wound on the upper side and the coil wire to be wound on the lower side are to be respectively led out, and the first partition portion has, on a winding portion side thereof, a step formed in a zone including a range between the lead-out cutout portion for the coil wire to be wound on the lower side and the lead-in cutout portion for the coil wire to be wound on the upper side.

2. The bobbin according to claim 1, wherein a depth T of the step satisfies $T \geq R$, where R is a wire radius of the coil wire to be wound on the lower side.

3. The bobbin according to claim 1, wherein the bobbin is formed by molding.

4. A coil device comprising:

the bobbin according to claim 1;

a first coil wire wound on the lower side at the winding portion; and a second coil wire wound in an overlapping manner on the upper side of the first coil wire, wherein a first one turn of the second coil wire introduced through the lead-in cutout portion for the second coil wire is provided in an overlapping manner between a final turn of the first coil wire along the step and an adjacent turn of the first coil wire wound adjacently to the final turn.

5. The coil device according to claim 4, wherein the first coil wire and the second coil wire are each wound in an even number of layers in a direction in which the step is provided from the lead-in cutout portion for the second coil wire to the lead-out cutout portion for the first coil wire, and on a side, of the first partition portion of the bobbin, that is opposite to the winding portion, a terminal is provided to which an end portion of the first coil wire led out from the lead-out cutout portion for the first coil wire and an end portion of the second coil wire led out from the lead-out cutout portion for the second coil wire, are connected.

6. The coil device according to claim 5, wherein on the side of the first partition portion of the bobbin that is opposite to the winding portion, a terminal mounting portion is provided adjacently to the lead-out cutout portion for the first coil wire and the lead-out cutout portion for the second coil wire, and the terminal is provided to the terminal mounting portion.

7. A bobbin, wherein on a side, opposite to the winding portion, of the second partition portion of the bobbin according to claim 1, a cylindrical second winding portion around which a coil wire is to be wound and a third partition portion at an end of the second winding portion are provided integrally.

8. A coil device comprising:

the bobbin according to claim 7;

a first coil wire wound on the lower side at the winding portion;

a second coil wire wound in an overlapping manner on the upper side of the first coil wire; and a third coil wire wound around the second winding portion, wherein a first one turn of the second coil wire introduced through the lead-in cutout portion for the second coil wire is provided in an overlapping manner between a final turn of the first coil wire along the step and an adjacent turn of the first coil wire wound adjacently to the final turn.

9. The coil device according to claim 8, wherein the first coil wire and the second coil wire are each wound in an even number of layers in a direction in which the step is provided from the lead-in cutout portion for the second coil wire to the lead-out cutout portion for the first coil wire, and on a side, of the first partition portion of the bobbin, that is opposite to the winding portion, a terminal is provided to which an end portion of the first coil wire led out from the lead-out cutout portion for the first coil wire and an end portion of the second coil wire led out from the lead-out cutout portion for the second coil wire, are connected.

10. The coil device according to claim 9, wherein on the side of the first partition portion of the bobbin that is opposite to the winding portion, a terminal mounting portion is provided adjacently to the lead-out cutout portion for the first coil wire and the lead-out cutout portion for the second coil wire, and the terminal is provided to the terminal mounting portion.

11. A bobbin, wherein on a side, opposite to the winding portion, of the first partition portion of the bobbin according to claim 1, a cylindrical second winding portion around which a coil wire is to be wound and a third partition portion at an end of the second winding portion are provided integrally.

12. A coil device comprising:

the bobbin according to claim 11;

a first coil wire wound on the lower side at the winding portion;

a second coil wire wound in an overlapping manner on the upper side of the first coil wire; and a third coil wire wound around the second winding portion, wherein a first one turn of the second coil wire introduced through the lead-in cutout portion for the second coil wire is provided in an overlapping manner between a final turn of the first coil wire along the step and an adjacent turn of the first coil wire wound adjacently to the final turn.

13. The coil device according to claim 12, wherein the third partition portion has a second lead-out cutout portion for the first coil wire and a second lead-out cutout portion for the second coil wire, the first coil wire and the second coil wire are each wound in an even number of layers in a direction in which the step is provided from the lead-in cutout portion for the second coil wire to the lead-out cutout portion for the first coil wire, and on a side, of the third partition portion of the bobbin, that is opposite to the second winding portion, a terminal is provided to which an end portion of the first coil wire passing through the lead-out cutout portion for the first coil wire and then led out from the second lead-out cutout portion, and an end portion of the second coil wire passing through the lead-out cutout portion for the second coil wire and then led out from the second lead-out cutout portion, are connected.

14. The coil device according to claim 13, wherein on the side of the third partition portion of the bobbin that is opposite to the second winding portion, a terminal mounting portion is provided adjacently to the second lead-out cutout portion for the first coil wire and the second lead-out cutout portion for the second coil wire, and the terminal is provided to the terminal mounting portion.

* * * * *